United States Patent [19]

Lea

[11] 3,967,572

[45] July 6, 1976

[54] ANCHORING SYSTEM AND CHAIN STOPPER THEREFOR

[75] Inventor: Freeman Roderick Lea, Orange, Calif.

[73] Assignee: Santa Fe International Corporation, Orange, Calif.

[22] Filed: Aug. 13, 1974

[21] Appl. No.: 497,114

[52] U.S. Cl. ..... 114/206 R; 114/200; 114/230

[51] Int. Cl.[2] ..... B63B 21/50

[58] Field of Search ..... 114/199, 200, 206 R, 114/230, .5 D

[56] References Cited

UNITED STATES PATENTS

| | | | |
|---|---|---|---|
| 3,160,135 | 12/1964 | DeVries | 114/.5 D |
| 3,685,305 | 8/1972 | Lloyd | 114/.5 D |
| 3,799,097 | 3/1974 | Robertson | 114/206 R |
| 3,842,776 | 10/1974 | Wudtke | 114/206 R |

FOREIGN PATENTS OR APPLICATIONS

| | | | |
|---|---|---|---|
| 2,185 | 8/1870 | United Kingdom | 114/200 |

*Primary Examiner*—Duane A. Reger
*Assistant Examiner*—Stuart M. Goldstein
*Attorney, Agent, or Firm*—LeBlanc & Shur

[57] ABSTRACT

Disclosed is a chain stopper including a pair of side-by-side support plates pivotally connected to hanger plates which support the chain stopper from the vessel's structure. The support plates releasably engage about the anchor chain to support the anchor from the vessel's structure. To haul in the anchor line, the line is winched in such that the connection between the anchor cable and anchor chain lies above the chain stopper which is suspended from support structure on the vessel. The chain stopper is engaged about the anchor chain and the winch is relieved to transfer the weight of the anchor chain and anchor to the chain stopper. The anchor cable is then disconnected from the anchor chain. A secondary chain hanging from a wildcat is connected to the anchor chain and hauled in whereby the weight of the anchor chain and anchor is transferred from the chain stopper to the secondary chain and wildcat. The chain stopper is disconnected from the anchor chain and the anchor chain and anchor are hauled in by the wildcat and secured in the normal manner. To unship the anchor from the vessel, the foregoing described procedure is reversed.

27 Claims, 13 Drawing Figures

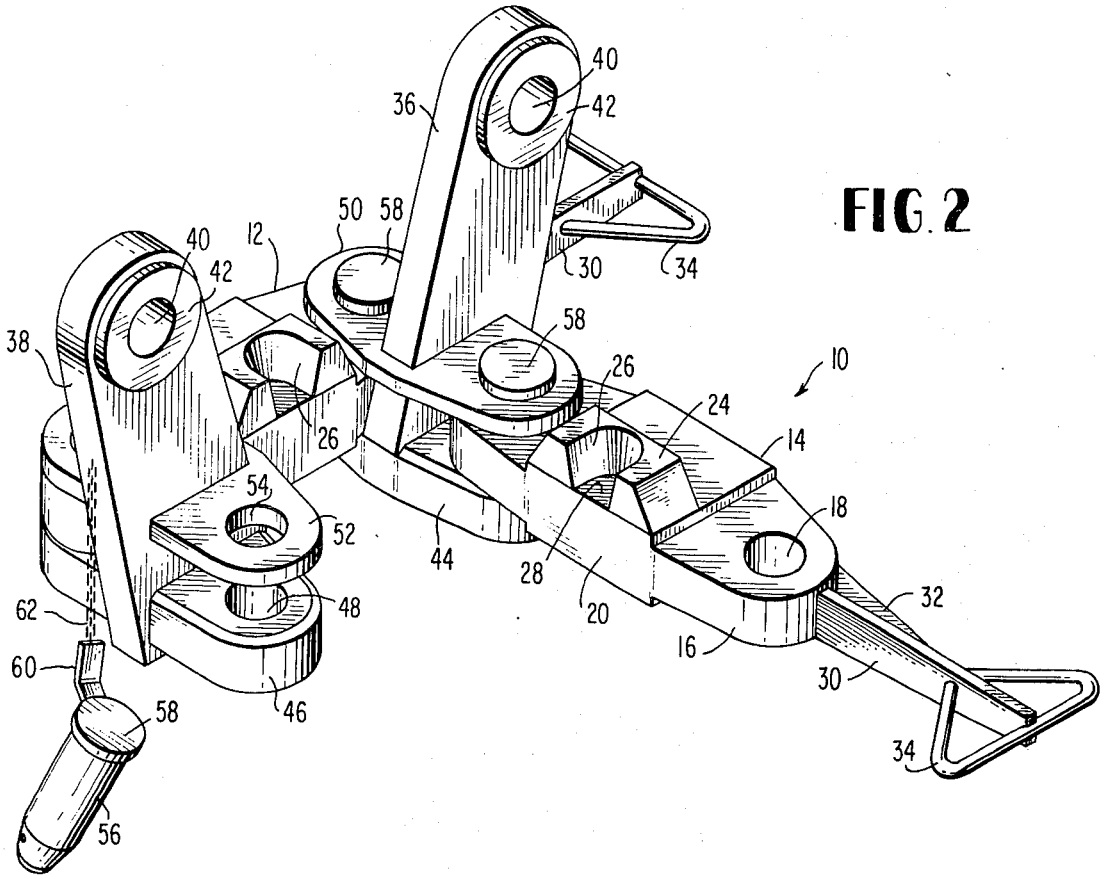
FIG. 2
FIG. 3
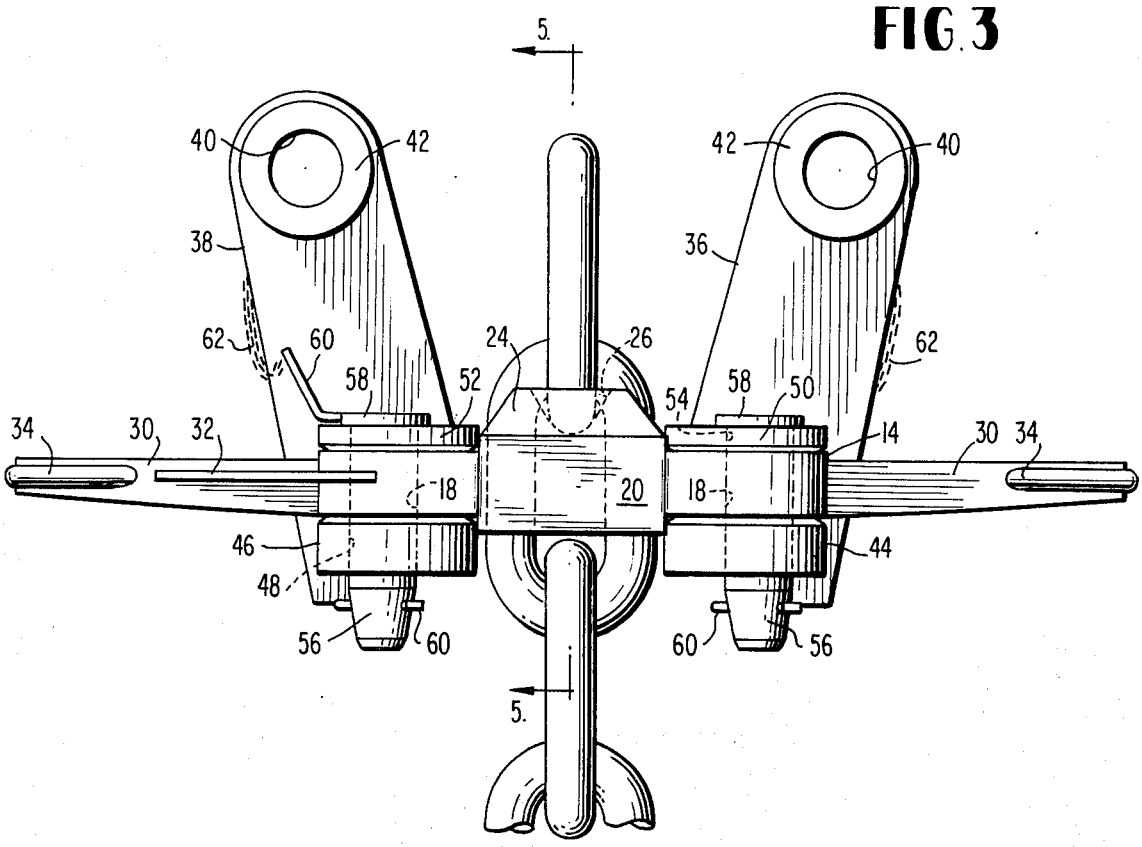

FIG. 4
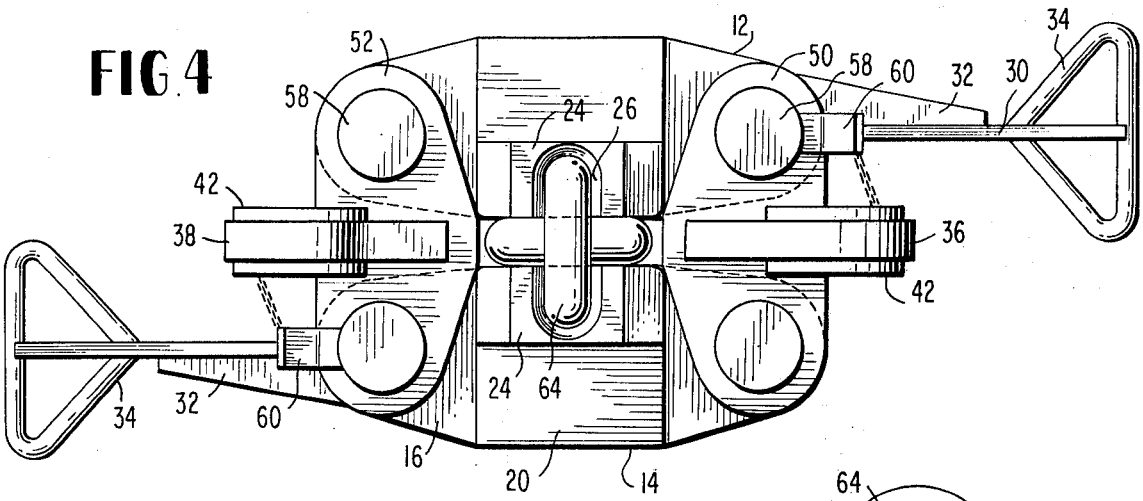
FIG. 11
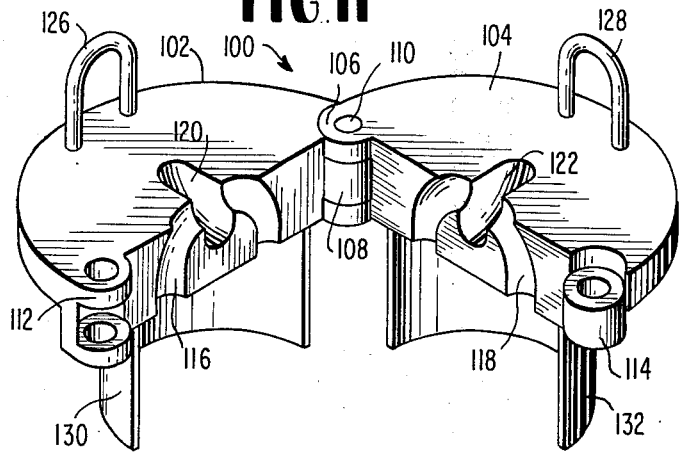
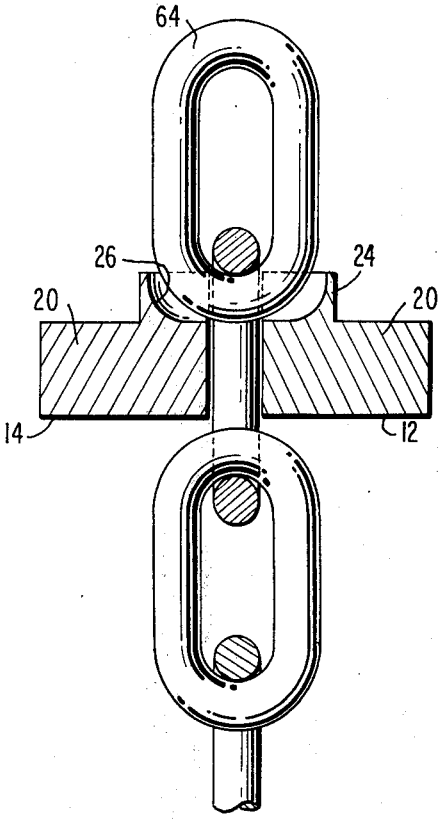
FIG. 5
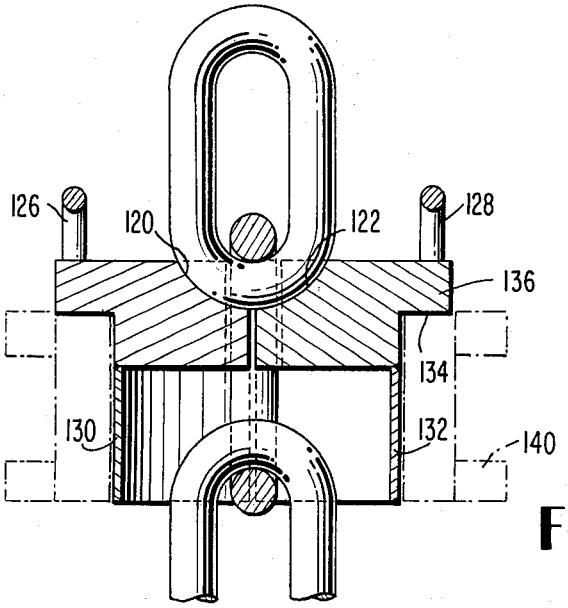
FIG. 12

70
72
74
76
78
80
82
84
88
90
10
64

ANCHORING SYSTEM AND CHAIN STOPPER THEREFOR

The present invention relates to methods and apparatus for handling anchor line carried by a vessel and particularly relates to methods and apparatus for handling a combination cable and chain anchor line, i.e., utilized by, but not limited to, offshore drilling, construction, pipelaying and other types of vessels.

In anchoring certain vessels, for example offshore drilling and construction vessels, it has been found preferable to utilize an anchor line consisting of a cable connected to a cable drum or winch on the offshore vessel and a length of chain which is connected at one end to the end of the cable and at its opposite end to an anchor. This combination cable and chain anchor line allows the maximum weight and holding power of the anchoring system to be concentrated at the end of the anchor line in contact with the sea bottom with the lighter cable carrying the anchor force between the anchor chain and the vessel. A principal disadvantage of this system, i.e., an anchor line comprised of a combination anchor chain and cable, has been that there is no simple effective means for handling both the cable and anchor chain on the offshore vessel. For example, when anchoring systems utilizing a combination cable and chain anchor line have been utilized preparatory to moving the anchored vessel, an anchor handling work boat, separate from the vessel, would pull the anchor line and anchor chain onboard. The anchor chain and anchor cable would then be disconnected one from the other. This operation necessitates a very large anchor handling boat, with a large hoist onboard, a large chain locker and further requires that handling the anchor, anchor chain and anchor cable as well as disconnecting the anchor cable and anchor chain be accomplished on the deck of the anchor handling work boat. Similar requirements are necessary during anchoring operations. These operations constitute a hazard for personnel on the work boat particularly during rough weather. Also, such operations are time consuming and not economical when considering the daily cost of operating a vessel, particularly, but not limited to, and offshore drilling vessel of a semisubmersible type. Further, such prior system requires the anchor handling boats to accompany the principal vessel to carry the anchors and chains therefore when the vessel is moved from one location to another or the very time consuming process of transferring the anchor equipment to the principal vessel.

The present invention provides an anchoring system which minimizes or eliminates the foregoing noted and other problems associated with prior anchoring systems and particularly provides a novel and improved anchoring system including apparatus and methods for handling a combination cable and chain anchor line having various advantages in construction, mode of operation, use and result in comparison with such prior anchoring systems. A principal feature of the present invention provides a vessel, for example, an offshore drilling or construction vessel of the semisubmersible type, with the capability for handling both the cable and chain of the anchor line and enables the anchors to be racked on such vessel as presently accomplished with all chain or all cable anchoring systems. To accomplish the foregoing, the anchoring system of the present invention provides a novel and unique chain stopper for releasably engaging the anchor chain and supporting the anchor chain and anchor from a structural part of the vessel while the anchor cable or a secondary chain used in the anchor system hereof as set forth hereinafter are connected to or disconnected from the anchor chain. The chain stopper includes a pair of side-by-side support plates pinned at opposite ends to a pair of vertically extending hanger plates along opposite sides of the chain stopper. Slings hung from a structural member carried by the vessel are connected to the hanger plates to support the chain stopper, as well as the anchor chain and anchor as set forth hereinafter, from the vessel. Each support plate has a removable pin at one end releasably connecting it to one of the hanger plates whereby the support plate is pivotal about its pinned connection to the other hanger plate at its opposite end between positions opening and closing the chain stopper. When open, the chain stopper can be man-handled to receive an anchor chain within or release on anchor chain from its confines. When the chain stopper is closed about an anchor chain, a link thereof is located between the support plates and the next link rests on shoulders carried by the support plates whereby the anchor chain and an anchor can be supported directly from the chain stopper.

To utilize the present anchoring system when the anchored vessel is to be moved, the anchor line is hauled in such that the location of the connection between the anchor cable and anchor chain lies at an elevation above the elevation of the chain stopper, and over a work platform. The chain stopper is suspended by slings from vessel support structure such as a winch or wildcat substructure. The chain stopper is then opened and man-handled to engage about the anchor chain such that one of its links rests on the support surfaces carried by the support plates of the chain stopper. By backing off the anchor winch, the weight of the anchor chain and anchor is transferred from the anchor winch to the chain stopper. The anchor cable is then disconnected from the anchor chain and the remaining portions of the anchor cable are hauled in and secured. A short or secondary chain is then lowered from a wildcat to a position directly above the first link of the anchor chain which, together with the anchor, are being supported by the chain stopper. A connecting link is utilized to connect the leading or uppermost link of the anchor chain above the chain stopper with the secondary chain. The anchor chain is then hauled in slightly by the wildcat to relieve the chain stopper, e.g., to transfer the weight of the anchor chain and anchor from the chain stopper to the wildcat. Thereafter, the chain stopper is opened, removed from the anchor chain and pulled clear thereof. The anchor chain and the anchor can then be hauled in by the wildcat and secured in a conventional manner.

To unship the anchor, the foregoing described procedures are reversed. That is, the anchor chain and anchor are lowered by the wildcat such that the upper end of the anchor chain lies at an elevation substantially coincident with the chain stopper. The chain stopper is then applied to and closed about the anchor chain. By paying out additional secondary chain from the wildcat, the weight of the anchor chain and anchor is transferred from the wildcat and secondary chain to the chain stopper. While the anchor chain and anchor are supported by the chain stopper, a connection between the end of the anchor cable and the uppermost link of the anchor chain is effected. Thereafter, the anchor winch is hauled in slightly to transfer the weight of the anchor chain and anchor from the chain stopper to the anchor winch. Once this is accomplished, the chain stopper is opened and removed from the anchor chain. The combination cable and chain anchor line is then payed out and the anchor is set in the usual manner, for example by using anchor boats to move the anchor and chain away from the vessel before dropping the anchor.

From the foregoing, it will be appreciated that many various and significant advantages are obtained by utilizing the anchoring system hereof. For example, the connection and disconnection between the anchor chain and anchor cable is made on the principal vessel per se. This is significant since this vessel provides a relatively stable and large working platform on which such anchor handling operations are conducted. In comparison, the deck of an anchor boat is smaller, and anchor handling operations cannot be efficiently conducted thereon, particularly in heavy weather since the extreme frequency and magnitude of the motions of the workboat caused by high wind and seas renders such operations hazardous. Also, the present anchoring system enables the cables, chains, and anchors to be stored onboard the principal vessel during transport and further enables the operator of the vessel to control directly all aspects of the anchoring system. Further, since the anchoring system hereof does not require that the anchor chain and anchor be lifted aboard an anchor boat and stored, it enables the anchoring operation to be accomplished with a much smaller anchoring boat than was previously required to handle a combination cable and chain anchor line. Still further, the present anchoring system does not require power sources in addition to the normal power provided the cable drum or require additional equipment apart from the chain stopper per se. This eliminates the investment in equipment such as the large wildcats and chain lockers on previously provided anchor boats and reduces the investment in the anchor boats per se since much smaller anchor boats can now be provided. Still further, the anchoring system hereof provides a versatility to vessels particularly, but not limited to, drilling vessels in that the combination anchor chain and cable used for proper mooring in deep water is readily converted to a chain anchoring system for use in shallow waters.

Accordingly, it is a primary object of the present invention to provide a novel and improved anchoring system including novel and improved apparatus and methods therefor.

It is another object of the present invention to provide a novel and improved anchorings system for handling a combination cable and chain anchor line.

It is another object of the present invention to provide a novel and improved chain stopper for use in handling a combination cable and chain anchor line.

It is a further object of the present invention to provide novel and improved methods for shipping and unshipping a combination cable and chain anchor line.

It is a still further object of the present invention to provide a novel and improved anchoring system for handling a combination cable and chain anchor line including novel apparatus therefor comprised of a chain stopper which is inexpensive, can be readily manhandled, is effective to secure the end link of the anchor chain in fixed position allowing connection therewith without having to lift or move the end of the anchor chain, maximizes the area of the supported link accessible to the connection to the anchor cable, and can be readily and easily moved to and out of the operational area.

These and further objects and advantages of the present invention will become more apparent upon reference to the following specification, appended claims and drawings wherein:

FIG. 2 is a perspective view of a preferred form of chain stopper for use with the anchoring system of the present invention and illustrates the chain stopper in an open position prior to securement thereof to the anchor chain;

FIG. 3 is a side elevational view of the chain stopper of FIG. 2 and illustrated in a closed position about an anchor chain;

FIG. 4 is a top plan view of the chain stopper illustrated in FIG. 3;

FIG. 5 is a cross-sectional view thereof taken generally about on line 5—5 in FIG. 3;

Figure 6A:
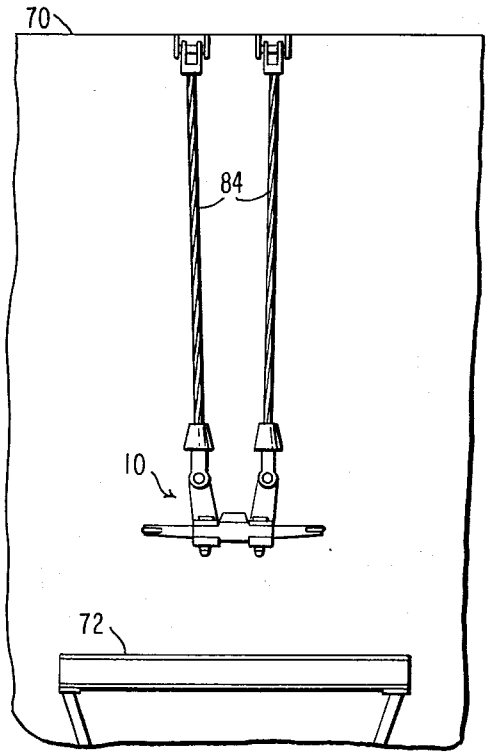
FIG. 6 is a fragmentary side elevational view schematically illustrating the relative locations of the anchor chain, anchor cable, chain stopper, anchor winch and wildcat for handling the combination cable and chain anchor line.
Figure 6:
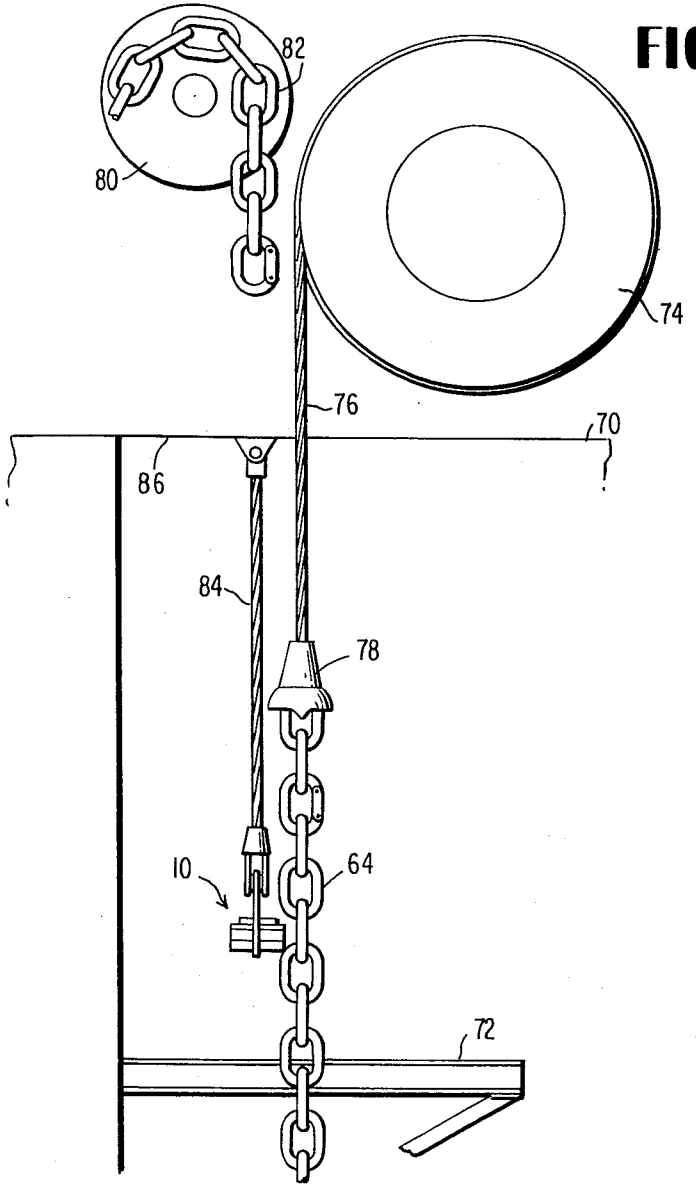

FIG. 6*a* is a side elevational view of the chain stopper and its support structure;

FIGS. 7–10 are side elevational views similar to FIG. 6 schematically illustrating the various steps for shipping the anchor, anchor chain and cable in accordance with the present invention;

FIG. 11 is a perspective view of another form of chain stopper hereof; and

FIG. 12 is a vertical cross-sectional view thereof illustrating the chain stopper of FIG. 11 with an anchor chain passing therethrough and with an elevator illustrated in phantom about the chain stopper.

Figure 1:
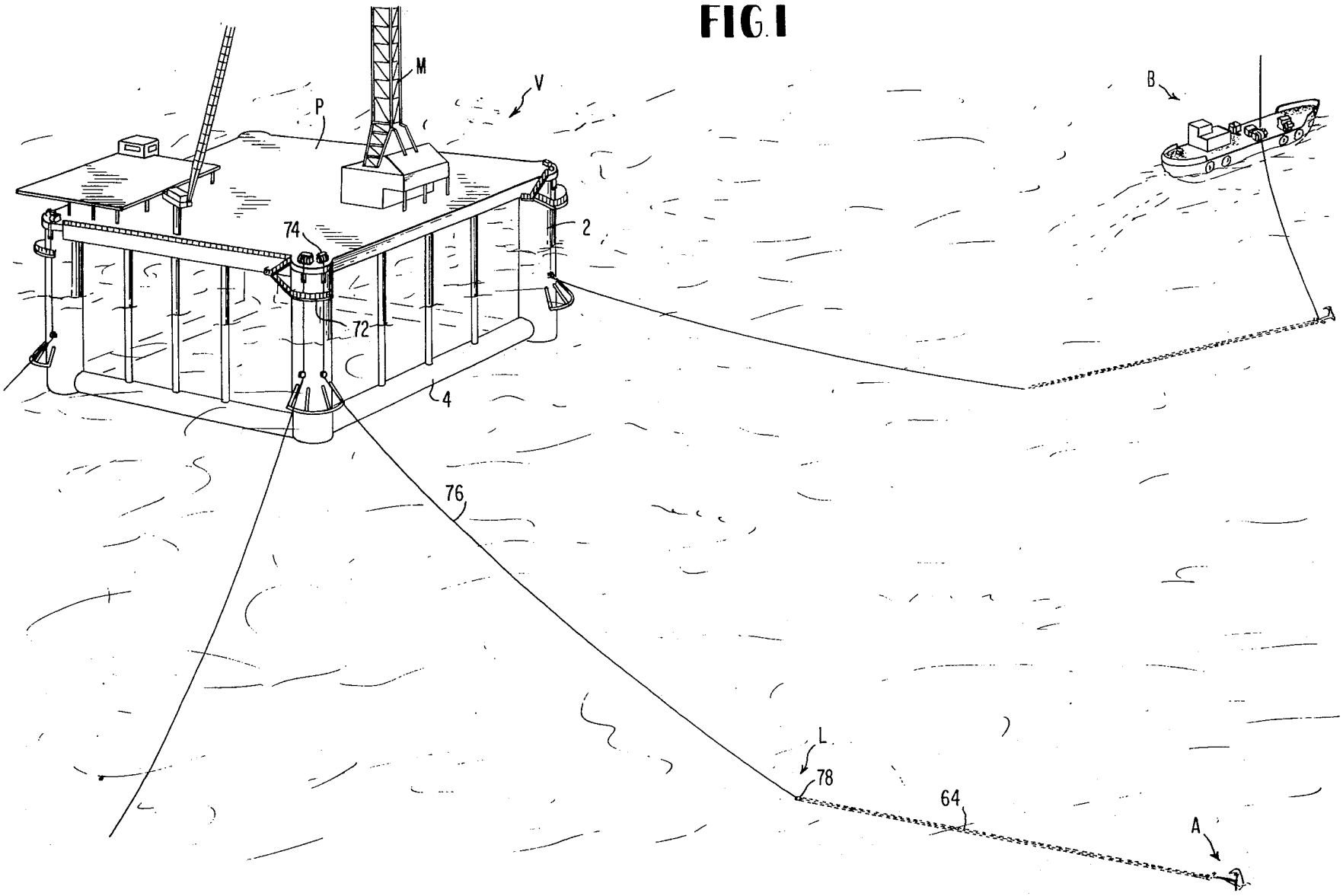
FIG. 1 is a perspective view of a vessel and an anchor boat and illustrating the vessel anchored by a combination chain and cable anchor line.

Referring now to the drawings, particularly to FIG. 1, there is schematically illustrated a vessel V anchored by means of anchor lines L terminating at their lower ends in anchors A. The vessel schematically illustrated in FIG. 1 is a column stabilized semisubmersible offshore drilling vessel of the type having stabilizing columns 2 located at each of its corners, a lower base structure 4 which is submerged when drilling and an upper platform P on which the drilling mast M and other equipment necessary for drilling operations are located. It will be appreciated, however, that the invention hereof may be utilized in conjunction with other types of vessels. The illustrated anchoring system is an eight point system. That is, a total of eight anchor lines are utilized with a pair each extending from each of the four corners of the vessel. As discussed hereinafter, the anchor lines extend from winches carried on platform P, downwardly along the columns and through fairleaders adjacent the lower end of the columns. An anchor boat B is illustrated handling a pendant line secured to an anchor A. The pendant line has a buoy, not shown, at its opposite end for locating the line and the anchor boat carries winches for lifting and setting the anchor. It is in this general environment in which the chain stopper, which will now be described in detail, and the anchoring system hereof is utilized.

Referring now particularly to FIGS. 2–5 there is illustrated a chain stopper generally designated 10 for use with the combination cable and chain anchoring system hereof. Chain stopper 10 includes a pair of elongated support members 12 and 14 each of which is preferably of unitary one piece construction and comprising a central block 20 with end ears and an opening 18 through each ear. On the upper surface of each central block 20, there is secured, preferably by welding, a plate 24 having a central recess 26. The lower portion of recess 26 is defined by an upper surface portion of central block 20 which forms a shoulder 28 defining a support surface for a portion of the link of an anchor chain as will become clear from the ensuing description. From a review of FIG. 3, it will be appreciated that the recesses 26 in blocks 24 lie in lateral registry or opposition one with the other when the chain stopper lies in a closed position whereby opposite side portions of a link of the anchor chain may be received within the opposed recesses 26 and supported on shoulders 28. A bracket 30 projects endwise from one end of each support member 12 and 14. When the chain stopper is closed as illustrated in FIG. 4, brackets 30 project from the opposite sides of the chain stopper. A gusset plate 32 reinforces the connection between each bracket 30 and the corresponding member 12 and 14. The outer end of each bracket 30 carries a tubular handle 34 and it will be appreciated that the chain stopper can be man-handled when suspended, that is, shifted laterally, as well as opened and closed in a manner to be set forth in ensuing description by use of handles 34.

Chain stopper 10 also includes a pair of hanger members 36 and 38. Each hanger member is a mirror image of the other whereby a description of one will suffice as a description of both. Each hanger member is comprised of a vertically extending plate which is inclined rearwardly in its plane and has an opening 40 passing through its upper end. Each of the side surfaces of the hanger plates about the opening 40 are provided with reinforcing annular plates 42. The lower forward edge of each hanger plate 36 is recessed. The hanger plates 36 and 38 carry a lower plate 44 and 46, respectively at their lower ends. Each lower plate 44 and 46 is centrally slotted along its outer side whereby the slotted portions of the lower plates receive the outer lower ends of the hanger plates and the recessed portions of the hanger plates receive the central portion of the lower plates. An opening 48 is provided through each of the lower plates 44 and 46 at its opposite ends. The hanger plates 36 and 38 carry upper plates 50 and 52 respectively. Each upper plate 50 and 52 is centrally slotted along its outer side for receiving an intermediate portion of the corresponding hanger plate. Each of the opposite ends of each upper plate is provided with an opening 54 which, when the upper and lower plates are secured to the hanger plates preferably by welding, lie in registry with the opening 48 through an end of the associated lower plate. Thus, the upper and lower plates on each side of each hanger plate form a slot for receiving an end portion or ear of the horizontally disposed support plates.

To secure the support plates to the hanger members, pins 56 are receivable in the aligned openings of the upper and lower plates and the openings in the end portions or ears of the support plates. The pins 56 have enlarged heads 58 and are releasably retained in the openings to secure the support members along respective opposite sides of the hanger members by cotter pins 60. Cotter pins 60 are releasably received in apertures in the lower ends of the pins when the pins are received in the openings of the upper and lower plates and the support plates. A pair of such pins 56 along opposite sides of the chain stopper each carry a bracket 60 secured to head 58 and to which bracket 60 is secured a chain 62. The opposite end of chain 62 is suitably secured to the hanger plate on the corresponding side of the chain stopper whereby the pins when removed remain coupled to the chain stopper. The pin provided with the bracket and chain securement constitutes the pin which secures the end of the support plate carrying the handle 34 to the one side of the hanger plate. Consequently, it will be appreciated that each of the support plates 12 and 14 are pivotal about a pin 56 at the opposite end of the support plate between a chain stopper open position as illustrated in FIG. 2 and a chain stopper closed and anchor chain supporting position illustrated in FIG. 4. When closed as illustrated in FIG. 4, the support plates 12 and 14 are spaced one from the other a distance slightly greater than the thickness of a link of the anchor chain and which chain is designated 64.

To utilize chain stopper 10 in the anchoring system hereof, reference is made to FIGS. 6–10. These drawing Figures schematically illustrate a procedure for hauling in the anchor aboard a vessel, for example the semisubmersible vessel of FIG. 1. Referring now to FIG. 6, there schematically is illustrated a part of the vessel's structure designated 70 including a working platform 72 (see also FIG. 1) on which men on the vessel may stand and handle the anchor line and chain stopper in a manner which will become clear from the ensuing description. Also carried on the vessel is a cable drum or winch 74 carrying the anchor line L and which line L is comprised of an anchor cable 76, an anchor chain 64, the anchor A, and a connection 78 for joining the anchor cable 76 and the anchor chain 64. Also carried by the vessel is a winch or wildcat 80 about which is reeved a secondary chain 82 for purposes which will become clear from the following description. Below wildcat 80, the chain stopper 10 is suspended by cables 84 from the winch or wildcat foundation 86 or other vessel supporting structure at an elevation to be easily handled by men standing on work platform 72 located on a side of the vessel or, in the case of a semisubmersible drilling vessel, located along a stabilizing column.

Figure 7:
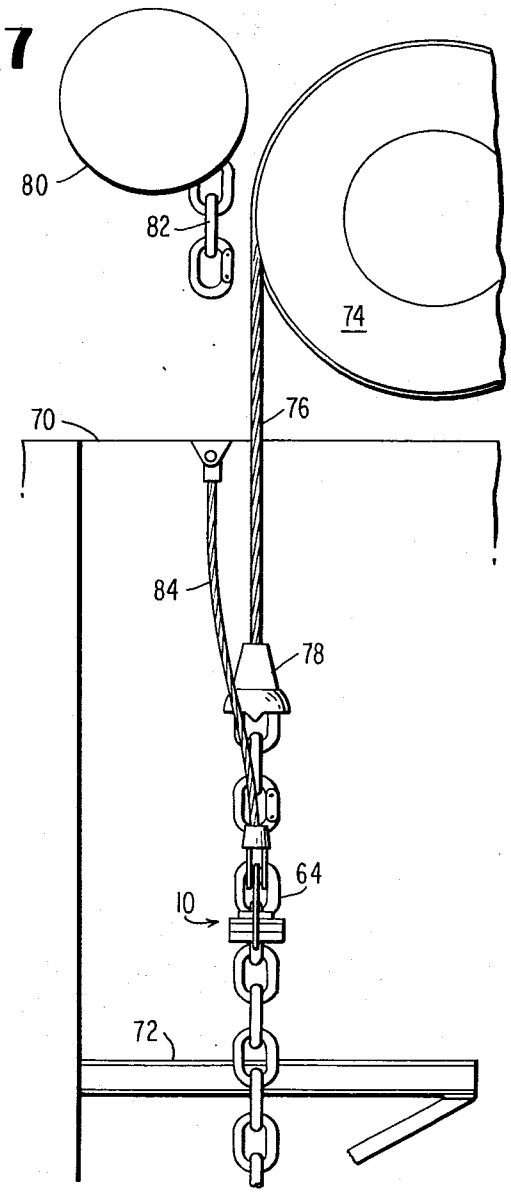

It will be appreciated that when the vessel is anchored, the anchor and at least a major portion of the anchor chain lie along the sea bottom with the cable forming the connection between the vessel and the anchor and anchor chain transferring the anchoring force from the anchor and anchor chain to the vessel. When the anchor is to be shipped aboard the vessel, the anchor boat B hauls in at least part of the pendant line to raise the anchor off the sea bottom. The cable drum 74 is also operated to haul in the anchor line until the connection 78 between the anchor cable 76 and anchor chain 64 lies at an elevation just above the elevation of the chain stopper 10. While the drum 74 hauls in the anchor line, the anchor boat moves toward the vessel V with the anchor suspended therefrom and off the sea bottom. The chain stopper is also opened by removing a pin 56 on one side thereof and either support member 12 or 14 is pivoted outwardly by workmen on work platform 72, the pin being hung from its chain 62. The chain stopper is then engaged about a link of the anchor chain 64 below the cable-chain connection 78, as illustrated in FIG. 7. The open support member is then pivoted to close about the link of the chain and the pin 56 is reinserted through the openings of the upper and lower plates carried by the hanger member and the opening through the end of the support member. When the chain stopper is closed, the lower portion of a link of the anchor chain rests on shoulders 28 in recesses 26. Preferably this link constitutes the uppermost link of the anchor chain just below a cable connection link 88. Cable drum 74 then pays out a small length of anchor cable 76 whereby the weight of the anchor chain 64 and anchor is transferred from the anchor cable 76 and drum 74 to chain stopper 10 and the slings 84 supporting chain stopper 10 from support structure 86 on the vessel. It will be appreciated that the anchor boat will have by this time released the anchor. With the weight of the anchor chain and anchor thus transferred the connection link 88 between the anchor chain 64 and connection 78 is opened, as illustrated in FIG. 7, and the anchor cable 76 and anchor chain 64 are disconnected one from the other. The remaining portions of the anchor cable 76 are then wound on the cable drum 74 and secured.

Figures 8, 9, 10:
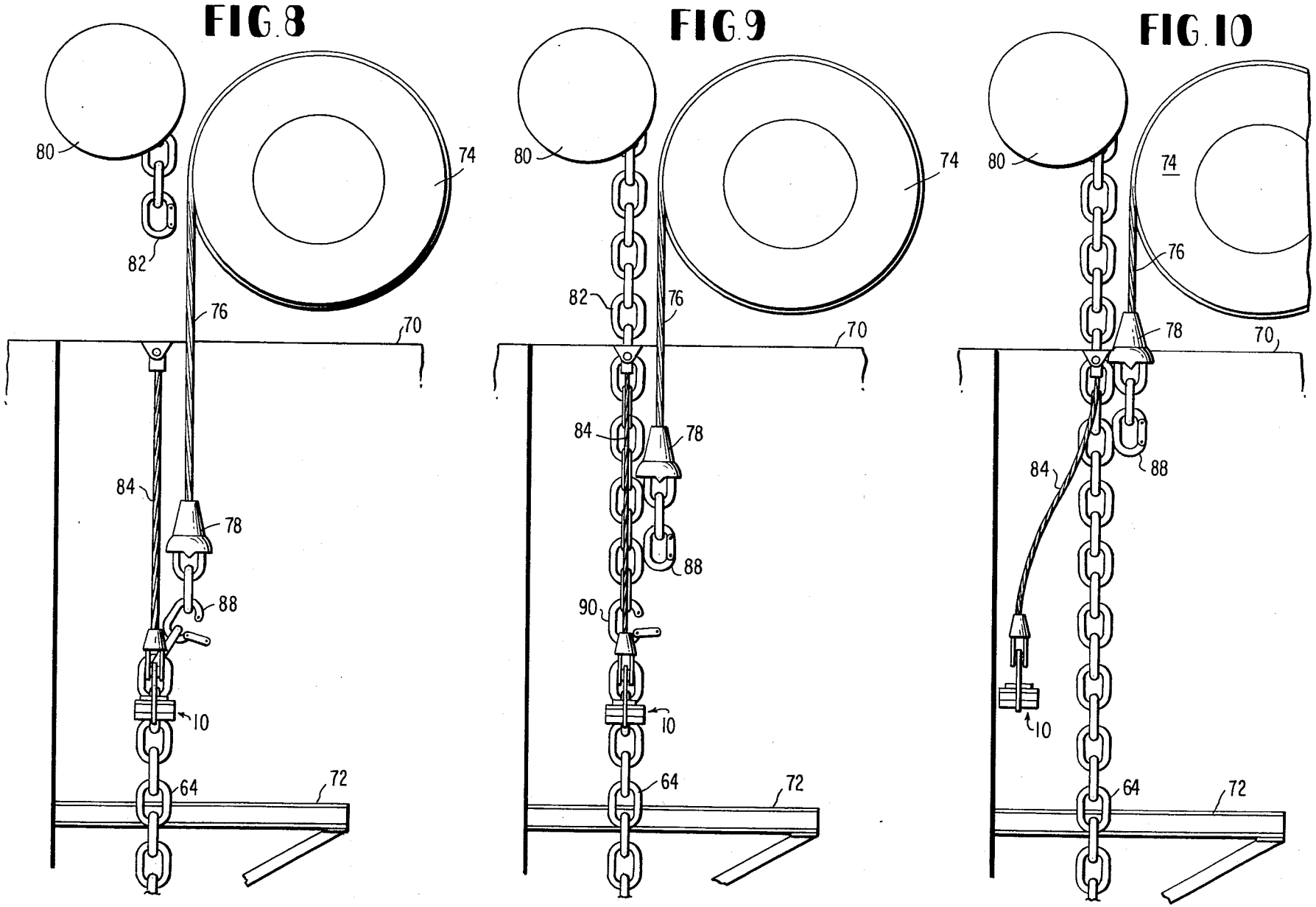

Referring to FIG. 9, the secondary chain 82 is lowered by wildcat 80 to a position directly above the first link of anchor chain 64. A connecting link 90 is installed between the lower end of the secondary chain 82 and the first link of the anchor chain 64. The secondary chain 82, anchor chain 64 and anchor are then hauled in slightly by the wildcat 80 to transfer the weight of the anchor chain 64 and anchor from chain stopper 10 to the secondary chain 82 and wildcat 80. A pin 56 on the chain stopper is then removed and a support member is swung outwardly to open the chain stopper whereby the chain stopper is disengaged from anchor chain 64. The chain stopper is pulled back as illustrated in FIG. 10 to clear the anchor chain 64 when the latter and the anchor are hauled in. Once the weight of the anchor chain and anchor is transferred to the wildcat, the anchor chain and anchor are hauled in and the anchor is secured in a conventional manner.

To unship the anchor, the foregoing described procedure is essentially reversed. The pendant line is secured to the anchor and the anchor boat carries the anchor by such line away from the vessel as the anchor chain 64 and secondary chain 82 as well as the anchor cable 76 are payed out. When the upper end of anchor chain 64 is located at an elevation just above chain stopper 10 and connection 78 lies adjacent the upper end of anchor chain 64, chain stopper 10 is opened and engaged about the upper end of anchor chain 64. The secondary chain 82 is payed out slightly whereby the weight of the anchor and anchor chain 64 is transferred from secondary chain 82 to chain stopper 10. A connection link 90 between secondary chain 82 and anchor chain 64 is then opened and the secondary chain 82 is disconnected from anchor chain 64, the anchor chain 64 and anchor being thereby fully supported by chain stopper 10. The connecting link 88 is then opened and the upper end of anchor chain 64 is connected to the cable-chain connection 78. Cable drum 74 is then hauled in slightly to transfer the weight of anchor chain 64 and the anchor from chain stopper 10 to anchor cable 76 and cable drum 74. Chainstopper 10 is thereafter disengaged from about anchor chain 64 and the combination cable and chain anchor line are payed out to the extent necessary and the anchor is dropped by the anchor boat.

It will be appreciated that the chain stopper 10 previously described is quite heavy. For example, a chain stopper of this type presently proposed for use with a 2000 foot anchor chain weighing approximately 50 pounds per foot in combination with an anchor weighting approximately 15 tons weighs on the order of over 700 pounds. While two workmen are able to shift the chain stopper laterally into and out of engagement with the anchor chain as set forth previously, the weight of the chain stopper can be considerably reduced rendering it more easily handled by the workmen to accomplish a like purpose as chain stopper 10 providing an additional piece of equipment, normally available on certain types of vessels, is utilized. To accomplish this, there is illustrated in FIGS. 11 and 12 another form of chain stopper constructed in accordance with the present invention and generally designated 100. Particularly, chain stopper 100 comprises a pair of support members 102 and 104 which comprise the opposite halves of a split disc having a thickness for example on the order of 4 inches or more. The support members 102 and 104 are pivotally connected one to the other adjacent one end edge along their diameters by a tongue and groove type interlocking connection. For example, support member 104 carries a pair of spaced ears 106 which receive a tongue 108 carried by the other support member 102. A pin 110 is received through aligned openings in ears 106 and tongue 108 to pivotally secure the support members 102 and 104 one to the other. At the opposite end of the diametrical edges of the split discs 102 and 104, there is provided a similar tongue and groove connection, with support member 102 carrying spaced ears 112 and support member 104 carrying a tongue 114, each of the ears 112 and tongue 114 having openings therethrough which register one with the other when the chain stopper 100 is closed. A pin, not shown, is receivable within the openings of the ears 112 and tongue 114 to secure the support members 102 and 104 one to the other when the chain stopper 100 is closed.

The opposing diametrical edges of the support members 102 and 104 are each grooved to receive portions of the links of an anchor chain. Particularly, generally vertically extending grooves 116 and 118 are provided in support members 102 and 104, respectively, to conform about the upper portions of a link of an anchor chain when chain stopper 100 lies in a closed position. Grooves 120 and 122 are provided through the upper surfaces of the support members 102 and 104, respectively, and at generally right angles to the grooves 116 and 118 when the chain stopper is closed whereby grooves 120 and 122 cooperate to receive the lower portions of the next uppermost link of the anchor chain when the chain stopper is closed about the chain. The anchor chain is illustrated in FIG. 12 within the chain stopper when the latter is closed. A pair of hooks 126 and 128 are carried by the support members 102 and 104, respectively, whereby chain stopper 100 can be suspended by small chains connected to a support on the vessel and at an elevation to be easily handled by men standing on a work platform, for example platform 74, on which the cable and chain connections and disconnections are to be made. A split cylindrical skirt 130 and 132 is secured along the underside of the support members 102 and 104, respectively, preferably by welding. The underside of support members 102 and 104 are also provided with a groove 134, the inner margin of the groove lying flush with the outer margin of the corresponding cylindrical skirts 130 and 132. Consequently, the lower portion of the split support members 102 and 104 and the skirt constitute a reduced diameter portion of the chain stopper with the upper portion of support members 102 and 104 in effect defining a radially outwardly projecting circumferentially extending flange 136. A standard side-door elevator 140 is illustrated in phantom in FIG. 11. The elevator is a split annular construction which can be engaged about and removed from chain stopper 100. The side door elevator 140 is suspended by cable slings and steel links not shown from a chain wildcat foundation preferably in such a manner that when elevator 140 is loaded with the chain stopper, anchor chain and anchor it will be hanging in vertical alignment with a secondary chain falling from the wildcat.

A chain stopper 100 which can be utilized with an anchoring system of the type previously described, i.e., an anchoring system utilizing 2000 feet of anchor chain weighing approximately 50 pounds per foot with a 15 ton anchor, can be formed of materials wherein the weight of the chain stopper approximates 400 pounds. Consequently, this chain stopper can be suspended from the vessel's structure with relatively small chains and readily manipulated and handled by workmen on the platform.

To utilize the chain stopper 100, the procedure is similar to the procedure previously described with respect to chain stopper 10. That is, to haul in a combination cable and chain anchor line, the cable drum hauls in the anchor cable until the connection between the cable and chain is located just above the elevation of the chain stopper. The chain stopper is opened, positioned about the anchor chain, preferably about its upper two links, and closed whereby such links are received in the grooves 116, 118, 120, and 122. The side door elevator 140 is then secured about chain stopper 100 and the weight of the anchor, anchor chain and chain stopper is transferred to the elevator 140 by paying out line from the cable drum. The connection link between the cable and anchor chain is opened and the cable is disconnected from the anchor chain with the cable being thereafter hauled up on the cable drum. The secondary chain, similar to chain 82 used with chain stopper 10, hanging from the wildcat, similar to wildcat 80 used with chain stopper 10, vertically aligned above the chain stopper is then lowered and coupled to the upper link of the anchor chain by utilizing a connection link. The anchor chain and anchor are then hauled in slightly by the wildcat to relieve the chain stopper and elevator and thereby transfer the weight of the anchor chain and anchor to the wildcat. The elevator 140 is then removed from about the chain stopper and the chain stopper is opened and pulled back from the anchor chain. The anchor chain and anchor can then be hauled in and secured in the normal manner.

To unship the anchor and anchor chain the foregoing procedure is essentially reversed, and is similar to the procedure for unshipping the anchor line as described previously in connection with the chain stopper 10. That is, the wildcat pays out the anchor chain and anchor until the connection between the secondary chain and the upper end of the anchor chain lie at an elevation approximately coincident with the elevation of the chain stopper. The chain stopper is opened and engaged about the upper links of the anchor chain and closed. The elevator 140 is disposed about the chain stopper. The wildcat is then payed out to transfer the weight of the anchor chain and anchor to the chain stopper and elevator, the latter supporting the former the vessel's structure. The cable drum is then payed out and the connecting link is utilized to connect the end of the cable to the upper length of the anchor chain. The cable drum is then hauled in slightly to relieve the chain stopper and elevator thereby transferring the weight of the anchor chain and anchor to the cable and cable drum. The elevator is then removed from about the chain stopper and the chain stopper is opened and pulled away from the anchor chain. The combination chain and cable anchor line is then payed out by the cable drum and anchoring operations are continued in a normal manner.

It will be appreciated that the foregoing described combination cable and chain anchor system fully accomplishes the objects of the present invention in that the connection and disconnection between the anchor cable and anchor chain are fully effected by workmen on the principal vessel. Consequently, smaller work or anchor boats may be employed using the anchoring system hereof since such boats do not require large winches or wildcats or a large chain locker for storing anchor chain. More particularly, the hazards of handling a combination chain and cable anchor line from the deck of a work boat particularly in heavy seas are entirely eliminated and the combined chain and cable anchor line can be more readily handled aboard the stable principal vessel. Furthermore, the cables, chains and anchors of the combined chain and cable anchoring line can be readily stored aboard the vessel during transport without any transfer thereof between an anchor boat and the principal vessel. Investment in additional equipment such as large winches is eliminated. Moreover, a vessel utilizing the anchoring system of the present invention obtains the dual capability of using such anchoring system for both shallow and deep water, that is, using a chain anchoring system in shallow water and a combination cable and chain anchoring system in deep water.

While the anchor line handling apparatus and method in accordance with the present invention have been described in conjunction with a vertically extending anchor line, it will be appreciated that such apparatus and methods can be utilized in handling the anchor cable to chain connection when the anchor line extends horizontally. For example, the anchor winch can be located on one side of the platform midway between the columns of the vessel illustrated in FIG. 1 with the anchor line extending over a fairleader at one of the columns. The handling apparatus hereof can be disposed between the fairleader and anchor winch and such apparatus and the methods hereof can be practised similarly as previously described.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. Apparatus for handling a combination cable and chain anchor line onboard a vessel comprising:

support structure forming a part of the vessel, said vessel constituting a semisubmersible type vessel having a lower base structure, a platform spaced above said base structure and a plurality of columns interconnecting between the platform and the base structure, a chain stopper carried by said support structure, means carried by the vessel defining a path of movement for the combination cable and chain anchor line relative to the vessel during anchor shipping and unshipping operations, and means connecting said chain stopper and said support structure one to the other to enable movement of said chain stopper relative to said support structure between a first position engageable about the chain portion of said anchor line along its path of movement and a second position spaced from the anchor chain and the path of movement of the anchor line, said chain stopper including a pair of support members movable toward and away from one another between positions engaging about and spaced from the anchor chain;

cooperating means carried by said support members for confining at least a portion of a link of said chain when said stopper lies in said first closed position whereby during anchor shipping operations said stopper will positively engage said line at a link of said chain against movement of said link relative to said stopper so that said chain may be disengaged from said cable.

2. Apparatus according to claim 1 wherein said support structure is located adjacent one of said columns, a workdeck disposed below said support structure, said chain stopper being suspended from said support structure above said workdeck, said anchor line path being located adjacent said workdeck, said connecting means including a flexible line coupled between said support structure and said chain stopper enabling movement of said chain stopper in a substantially lateral direction between said first and second positions and toward and away from the path of movement of the anchor line.

3. Apparatus according to claim 2 including a winch carried by said vessel and carrying a chain, an end portion of said chain being adapted for disposition below said support structure and above said workdeck.

4. Apparatus according to claim 3 including a cable drum carried by said platform for winding the cable portion of the anchor line.

5. Apparatus according to claim 4 including said combination cable and chain anchor line, means for connecting one end of said anchor chain to an end of said anchor cable, an anchor carried by the opposite end of said anchor chain, said winch being adapted to haul in and pay out said anchor chain.

6. Apparatus for handling a combination cable and chain anchor line onboard a vessel comprising:

support structure forming a part of the vessel, a chain stopper carried by said support structure, means carried by the vessel defining a path movement for the combination cable and chain anchor line relative to the vessel during anchor shipping and unshipping operations, and means connecting said chain stopper and said support structure one to the other to enable movement of said chain stopper relative to said support structure between a first position engageable about the chain portion of said anchor line along its path of movement and a second position spaced from the anchor chain and the path of movement of the anchor line, said chain stopper including a pair of support members movable toward and away from one another between positions engaging about and spaced from the anchor chain;

cooperating means carried by said support members for confining at least a portion of a link of said chain when said stopper lies in said first closed position whereby during anchor shipping operations said stopper will positively engage said line at a link of said chain against movement of said link relative to said stopper so that said chain may be disengaged from said cable.

7. Apparatus for handling a combination cable and chain anchor line onboard a vessel comprising:

support structure forming a part of the vessel, a chain stopper carried by said support structure, means carried by the vessel defining a path of movement for the anchor line relative to the vessel during anchor shipping and unshipping operations, and means connecting said chain stopper and said support structure one to the other to enable movement of said chain stopper relative to said support structure between a first position engageable about the anchor chain along its path of movement and a second position spaced from the anchor chain and the path of movement of the anchor line, said chain stopper including a pair of support members movable toward and away from one another between positions engaging about and spaced from the anchor chain, said support members including first and second members disposed in generally side-by-side relation one with the other, each of said members having a generally centrally located surface lying in transverse alignment with the surface carried by the other member for supporting a portion of a link of the anchor chain when said members lie in side-by-side relation one with the other, first and second hanger members, means carried by each of said hanger members for connecting said hanger members and respective like ends of said support members including a pivotal connection between an end portion of said first support member and said first hanger member whereby said first support member is pivotal toward and away from said second support member, and means for releasably securing the opposite end portion of said first support member and said second hanger member, said first support member lying in side-by-side relation with said second support member when said first support member is releasably secured to said second hanger member and when said stopper is closed enabling a link of a chain disposed between said support members to engage said surfaces for support of the anchor chain from the stopper said first support member being pivotal away from said second support member upon release of said securing means to open said stopper and enable disengagement of said stopper and the chain.

8. Apparatus according to claim 7 wherein said first support member has a handle carried thereby adjacent said opposite end portion thereof whereby said member can be handled for movement between positions opening and closing the chain stopper.

9. Apparatus according to claim 7 wherein each of said first and second support members has a recess formed in its upper surface in lateral registry with the recess formed in the upper surface of the other support member for confining a link of a chain when said stopper lies in said closed position thereof.

10. Apparatus according to claim 7 wherein portions of said hanger members lie between said support members at opposite ends thereof whereby the anchor chain through the stopper in its closed position is bounded in a plane normal thereto by said support members and said hanger members.

11. Apparatus according to claim 10 wherein said hanger members incline outwardly away from said support membes, and means carried by said hanger members at their distal ends for connecting the chain stopper to said support structure.

12. Apparatus according to claim 10 wherein the portions of said hanger members between said support members each carry a pair of ears projecting laterally outwardly from each of its opposite sides, each ear having an opening in registry with the other ear of such pair thereof, the opposite ends of each support member being receivable between a pair of ears of said hanger member on like sides thereof and having an opening in registry with the registering openings through such pair of ears, and a plurality of pins, each of said pins being receivable within the respective aligned openings through the ears and support members to secure the hanger members and support members one to the other.

13. Apparatus according to claim 12 wherein said releasable securing means includes one of said pins.

14. Apparatus according to claim 13 including means for releasably retaining said pins in said aligned openings.

15. Apparatus according to claim 14 wherein at least another of said pins is removable from the aligned openings of the ears and end portion of said second support plate to enable said second support plate to pivot in the first mentioned plane about the pin through the opposite end of said second support plate between stopper open and closed positions whereby the stopper is releasably engageable about the anchor chain receivable through the other side of the stopper when open, the surfaces of the support plates being engageable with a link of the anchor chain when the stopper is closed.

16. Apparatus according to claim 15 including means carried by each of the upper ends of said hanger plates for suspending the stopper from said support structure.

17. Apparatus for handling a combination cable and chain anchor line onboard a vessel comprising:

support structure forming a part of the vessel, a chain stopper carried by said support structure, means carried by the vessel defining a path of movement for the anchor line relative to the vessel during anchor shipping and unshipping operations, and means connecting said chain stopper and said support structure one to the other to enable movement of said chain stopper relative to said support structure between a first position engageable about the anchor chain along its path of movement and a second position spaced from the anchor chain and the path of movement of the anchor line, said chain including a pair of support members movable toward and away from one another between positions engaging about and spaced from the anchor chain, said support members including first and second elongated metal support plates disposed in spaced generally side-by-side and coplanar relation one to the other, each of said plates having an opening at each end and a support surface intermediate said ends, first and second metal hanger plates disposed in spaced generally coplanar relation one the the other and in a plane generally normal to the plane containing said support plates, each of said hanger plates including a pair of spaced ears projecting to each side thereof and from the lower end portion of the hanger plate, each pair of ears having registering openings therethrough, said first support plate lying on one side on the plane containing said hanger plates with its opposite ends disposed between the respective pairs of ears of said hanger plates on said one side thereof, said second support plate lying on the other side of the plane containing said hanger plates with its opposite ends disposed between the respective pairs of ears of said hanger plates on said other side thereof, pins engageable through the aligned openings of each pair of ears and the end of the support member disposed therebetween to secure said support plates and said hanger plates one to the other, at least one of said pins being removable from the aligned openings of the ears and end portion of said first support plate to enable said first support plate to pivot in the first mentioned plane about the pin through the opposite end of said first support plate between stopper open and closed positions whereby the stopper is releasably engageable about said anchor chain receivable through one side thereof when open, the surfaces of said support plates being engageable with a link of said anchor chain when said stopper is closed.

18. Apparatus according to claim 17 including a handle carried by said first support plate to facilitate movement thereof between a position closing the stopper about said anchor chain and an open position for releasing the anchor chain from the stopper.

19. A chain stopper according to claim 6 wherein said first support member has a handle carried thereby adjacent said opposite end portion thereof whereby said member can be handled for movement between positions opening and closing the chain stopper.

20. A chain stopper according to claim 6 wherein each of said first and second support members has a recess formed in its upper surface in lateral registry with the recess formed in the upper surface of the other support member for confining a link of a chain when said stopper lies in said closed position thereof.

21. A chain stopper according to claim 6 wherein portions of said hanger members lie between said support members at opposite ends thereof whereby the anchor chain through the stopper in its closed position is bounded in a plane normal thereto by said support members and said hanger members.

22. A chain stopper according to claim 21 wherein said hanger members incline outwardly away from said support members, and means carried by said hanger members at their distal ends for connecting the chain stopper to said support structure.

23. A chain stopper according to claim 21 wherein the portions of said hanger members between said support members each carry a pair of ears projecting laterally outwardly from each of its opposite sides, each ear having an opening in registry with the other ear of such pair thereof, the opposite ends of each support member being receivable between a pair of ears of said hanger member on like sides thereof and having an opening in registry with the registering openings through such pair of ears, and a plurality of pins, each of said pins being receivable within the respective aligned openings through the ears and support members to secure the hanger members and support members one to the other.

24. A chain stopper according to claim 23 wherein said releasable securing means includes one of said pins.

25. A chain stopper according to claim 24 including means for releasably retaining said pins in said aligned openings.

26. A chain stopper according to claim 25 wherein at least another of said pins is removable from the aligned openings of the ears and end portion of said second support plate to enable said second support plate to pivot in the first mentioned plane about the pin through the opposite end of said second support plate between stopper open and closed positions whereby the stopper is releasably engageable about the anchor chain receivable through the other side of the stopper when open, the surfaces of the support plates being engageable with a link of the anchor chain when the stopper is closed.

27. A chain stopper according to claim 26 including means carried by each of the upper ends of said hanger plates for suspending the stopper from said support structure.

* * * * *